US010195496B2

(12) United States Patent
Lau et al.

(10) Patent No.: US 10,195,496 B2
(45) Date of Patent: Feb. 5, 2019

(54) SUPERELASTIC RACKET STRING

(71) Applicant: Head Technology GmbH, Kennelbach (AT)

(72) Inventors: Daniel Lau, Dornbirn (AT); Johan Kotze, Wolfurt (AT)

(73) Assignee: Head Technology GmbH, Kennelbach (AT)

( * ) Notice: Subject to any disclaimer, the term of this patent is extended or adjusted under 35 U.S.C. 154(b) by 0 days.

(21) Appl. No.: 15/522,996

(22) PCT Filed: Oct. 28, 2015

(86) PCT No.: PCT/EP2015/075023
§ 371 (c)(1),
(2) Date: Apr. 28, 2017

(87) PCT Pub. No.: WO2016/066706
PCT Pub. Date: May 6, 2016

(65) Prior Publication Data

US 2017/0312589 A1 Nov. 2, 2017

(30) Foreign Application Priority Data

Oct. 30, 2014 (DE) ..... 10 2014 016 105

(51) Int. Cl.

| | |
|---|---|
| ***A63B 51/02*** | (2015.01) |
| ***C22C 19/00*** | (2006.01) |
| ***C22F 1/00*** | (2006.01) |
| ***C22C 14/00*** | (2006.01) |
| *C22F 1/10* | (2006.01) |
| *A63B 51/00* | (2015.01) |

(Continued)

(52) U.S. Cl.
CPC ..... *A63B 51/02* (2013.01); *C22C 14/00* (2013.01); *C22C 19/007* (2013.01); *C22F 1/006* (2013.01); *A63B 2051/001* (2013.01); *A63B 2051/023* (2013.01); *A63B 2102/02* (2015.10); *A63B 2102/04* (2015.10); *A63B 2102/06* (2015.10); *A63B 2102/065* (2015.10); *A63B 2209/00* (2013.01); *C22C 19/03* (2013.01); *C22F 1/10* (2013.01)

(58) Field of Classification Search
CPC ... A63B 51/00; A63B 51/02; A63B 2051/023; A63B 2051/001; A63B 2102/04; A63B 2012/06; A63B 2102/065; A63B 2209/00; C22C 14/00; C22C 19/03; C22C 19/007; C22F 1/006; C22F 1/10
See application file for complete search history.

(56) References Cited

U.S. PATENT DOCUMENTS

| | | | | |
|---|---|---|---|---|
| 4,505,767 A | | 3/1985 | Quin | |
| 4,909,510 A | * | 3/1990 | Sahatjian ..... | A63B 51/02 473/537 |

(Continued)

FOREIGN PATENT DOCUMENTS

| | | | |
|---|---|---|---|
| WO | 90/08575 | A1 | 8/1990 |
| WO | 9308880 | A1 | 5/1993 |

(Continued)

*Primary Examiner* — Raleigh W Chiu
(74) *Attorney, Agent, or Firm* — Bookoff McAndrews, PLLC

(57) ABSTRACT

The present invention relates to a ball game racket with strings that comprise at least one string comprising a superelastic material.

19 Claims, 1 Drawing Sheet

Figure 1:
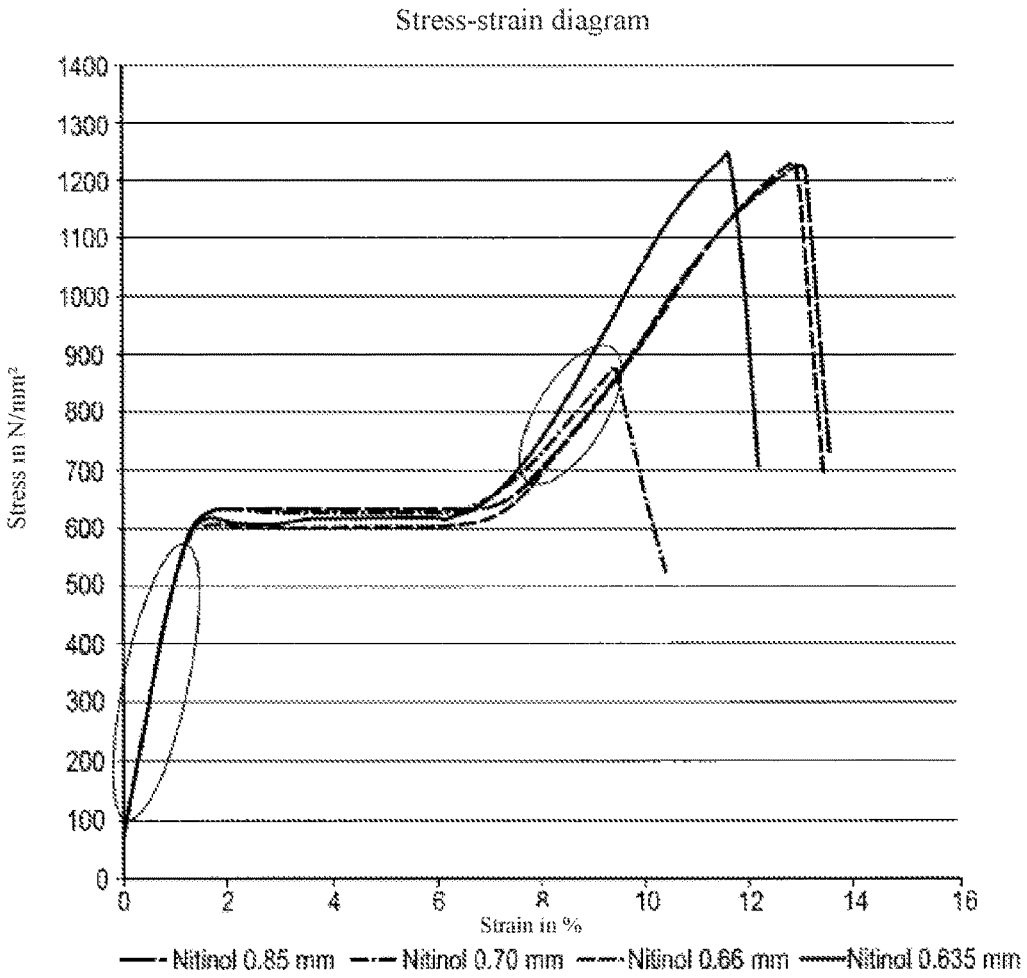

(51) Int. Cl.

| | |
|---|---|
| *A63B 102/02* | (2015.01) |
| *A63B 102/04* | (2015.01) |
| *A63B 102/06* | (2015.01) |
| *C22C 19/03* | (2006.01) |

(56) References Cited

U.S. PATENT DOCUMENTS

| | | | | |
|---|---|---|---|---|
| 6,270,427 | B1 * | 8/2001 | Derbin | A63B 37/0003 473/360 |
| 6,625,848 | B1 * | 9/2003 | Schneider | A01B 1/02 16/436 |
| 2002/0035912 | A1 | 3/2002 | Barney | |
| 2002/0098924 | A1 * | 7/2002 | Houser | A63B 49/00 473/524 |
| 2010/0087280 | A1 | 4/2010 | Blades | |
| 2017/0312589 | A1 * | 11/2017 | Lau | A63B 51/02 |

FOREIGN PATENT DOCUMENTS

| | | | |
|---|---|---|---|
| WO | 95/27092 | | 10/1995 |
| WO | 9920357 | A1 | 4/1999 |

* cited by examiner

SUPERELASTIC RACKET STRING

The present invention relates to a string for a ball game racket which comprises a superelastic or pseudoelastic material, as well as to a ball game racket having strings at least one of which comprises a superelastic or pseudoelastic material.

Strings for ball game rackets such as, for example, tennis rackets, squash rackets, badminton rackets, racquetball rackets and the like are produced from a great variety of materials. Ball game racket strings originally consisted of natural gut, in particular cow gut. Such natural gut strings still excel in high elasticity and tension stability. However, they are also very expensive and relatively weather sensitive. Therefore, synthetic strings made from nylon or polyester have primarily established themselves.

The demands that ball game racket strings have to meet in terms of mechanical properties are generally relatively high and complex. Ball game racket strings should possess high specific strength, low rigidity and a high elongation at failure. The dampening properties as well as stress relaxation also play a role. None of the known materials for ball game racket strings is able to meet all these requirements to the highest degree.

Hence, it is a problem of the present invention to provide a material for ball game racket strings by means of which the mechanical properties of conventional ball game racket strings can be generally improved or selectively modified.

The present invention is based on the idea of providing a ball game racket string, in particular a string for a tennis racket, squash racket, badminton racket or racquetball racket, that consists of a superelastic or pseudoelastic material or comprises a superelastic or pseudoelastic material.

Even though, at first, the application of a superelastic material with its complex stress-strain behaviour may seem to be absurd for the use in a ball game racket string, numerous advantages ensue therefrom which can drastically influence the playing behaviour of a ball game racket stringed with such strings.

First of all, the tensile strength of superelastic materials such as, for example, nitinol is many times higher than the tensile strength of, for example, natural gut or polyester. Hence, with a required breaking load of, for example, tennis strings of 450 N, the diameter of a tennis string consisting of, for example, nitinol can be considerably reduced in comparison to conventional strings, as apparent from the following table:

| Material | Tensile strength | Density | Required string diameter | String mass |
|---|---|---|---|---|
| Natural gut | 300 MPa | 1.35 g/cm$^3$ | 1.40 mm | 2.07 g/m |
| Polyester | 400 MPa | 1.35 g/cm$^3$ | 1.20 mm | 1.53 g/m |
| Superelastic nitinol S/BB (As = −15° C.) | 1200 MPa | 6.5 g/cm$^3$ | 0.69 mm | 2.43 g/m |

In other words, the diameter of a nitinol string can be reduced by about a factor of 2 compared to a natural gut string at the same breaking load, which entails, for example, a not immaterial influence on the aerodynamics of a ball game racket stringed with such a string.

A further advantage of superelastic materials resides in that the tensile stiffness can be massively influenced due to the phase transition between austenite and martensite. On the basis of the aforementioned required diameters for the strings and the respective Young's moduli, the following tensile stiffnesses are obtained:

| Material | Required Ø | Cross-sectional area | Young's modulus | Tensile stiffness |
|---|---|---|---|---|
| Natural gut | 1.40 mm | 1.54 mm$^2$ | 4 GPa | 11.3 kN |
| Polyester | 1.20 mm | 1.13 mm$^2$ | 14.4 GPa | 16.3 kN |
| S/BB As −15° C. (A) | 0.69 mm | 0.374 mm$^2$ | 75 GPa | 28.1 kN |
| S/BB As −15° C. (M) | 0.69 mm | 0.374 mm$^2$ | 30 GPa | 11.2 kN |

In the case of martensite, the tensile stiffness of the nitinol string approximately corresponds to the tensile stiffness of the natural gut string, whereas in the case of austenitic nitinol it is considerably higher. The advantage of superelastic materials, i.a., resides in that the tensile stiffness can be determined by the string tension of the ball game racket, i.e. it can be determined by the prestress applied to the string whether the superelastic material is present in the austenitic or martensitic state, since the phase diagram of superelastic materials depends on the stress applied.

Usually, a first phase transition, at which austenite is transformed into martensite, occurs in a superelastic material when the tensile stress increases. Both below and above this phase transition a superelastic material behaves essentially linearly in the stress-strain diagram. However, in the range of the phase transition itself, the strain may massively increase without the stress having to be increased since in this case the strain is due to a transformation from austenite into martensite. When the tensile stress applied is reduced again, a second phase transition occurs, at which martensite is retransformed into austenite. Since this second phase transition occurs at a lower tensile stress than the first phase transition, this is also referred to as a hysteresis.

Preferably, the first phase transition of the superelastic material occurs at room temperature at a tensile stress between 250 MPa and 900 MPa, more preferably at a tensile stress between 300 MPa and 800 MPa and most preferably at a tensile stress between 350 MPa and 700 MPa. What is meant in the context of the present invention by the tensile stress at which the first phase transition "occurs" is preferably the tensile stress at which the strain is 3%. In the technical jargon, this is also referred to as upper plateau stress.

Preferably, the second phase transition of the superelastic material occurs at room temperature at a tensile stress between 50 MPa and 700 MPa, more preferably at a tensile stress between 150 MPa and 650 MPa and most preferably at a tensile stress between 250 MPa and 600 MPa. What is meant in the context of the present invention by the tensile stress at which the second phase transition "occurs" is preferably the tensile stress at which the strain is 2.5%. In the technical jargon, this is also referred to as lower plateau stress.

Preferably, the difference between the tensile stress at which the first phase transition occurs or starts and the tensile stress at which the second phase transition occurs or starts at room temperature is smaller than 350 MPa, more preferably smaller than 300 MPa and most preferably smaller than 250 MPa.

In the ball game racket according to the present invention, different "working points" can be defined in order to take advantage of the different properties of the superelastic material. According to a first preferred embodiment of the ball game racket according to the present invention, a prestress that is higher than the tensile stress at which the first phase transition occurs or starts can be applied to the strings of the ball game racket. In other words, this aspect is directed to a ball game racket with strings that comprise at least one string comprising or consisting of a superelastic material in the martensitic state. As apparent from the data indicated above, the tensile stiffness in the case of nitinol would in this case essentially correspond to that of a natural gut string. This could be achieved, however, with a distinctly smaller string diameter of preferably no greater than 1.1 mm, more preferably no greater than 0.9 mm and most preferably no greater than 0.8 mm.

According to a second preferred embodiment of the ball game racket according to the present invention, a prestress that is lower than the tensile stress at which the first phase transition occurs or starts can be applied to the strings. In other words, this aspect is directed to a ball game racket with strings that comprise at least one string comprising or consisting of a superelastic material in the austenitic state. Advantage can be taken of the extremely high tensile stiffness of, for example, austenitic nitinol (see above) while at the same time the phase transition of the superelastic material can be deliberately avoided. To this end it is preferred that the difference between the tensile stress at which the first phase transition occurs or starts and the prestress applied to the strings at room temperature is greater than 100 MPa, more preferably greater than 200 MPa and most preferably greater than 300 MPa. This prerequisite is based on the idea that the forces typically occurring during playing the ball game racket should not entail so high a stress within the string that the string material enters the phase transition. In this way, a relatively stiff metal string having a high strength is obtained which, however, otherwise behaves like a conventional string.

Generally, the increase in force within the string during a stroke considerably depends on the prestress, the stringing pattern, the tensile stiffness of the string and, of course, the hardness of the player's strokes. Under extreme circumstances, increases in force in the order of 200 N can be achieved by professional players. Usually, however, 150 N are not exceeded. In the case of an assumed increase in force of 150 N, an increase of stress of 158 MPa results with a string diameter of 1.1 mm (i.e., a cross-sectional area of 0.95 $mm^2$). When the string diameter is only 0.9 mm (i.e., the cross-sectional area is 0.636 $mm^2$) or 0.8 mm (i.e., the cross-sectional area is 0.502 $mm^2$), the same increase in force in the string leads to an increase in stress of 236 MPa or 299 MPa, respectively. Accordingly, as regards strings having a diameter of greater than 1 mm, it is preferred that the difference between the tensile stress at which the first phase transition occurs or starts and the prestress applied to the strings at room temperature is greater than 100 MPa, more preferably greater than 125 MPa and most preferably greater than 150 MPa. As regards strings having a diameter of smaller than 1 mm, it is preferred that the difference between the tensile stress at which the first phase transition occurs or starts and the prestress applied to the strings at room temperature is greater than 200 MPa, more preferably greater than 250 MPa and most preferably greater than 300 MPa.

According to a third preferred embodiment, however, it is also possible that the prestress applied to the strings is such that, with the forces usually occurring during the game, the string material undergoes the phase transition and most preferably the complete hysteresis of the phase transition. To this end it is preferred that the prestress applied to the strings is lower than the tensile stress at which the first phase transition occurs or starts, wherein at the same time the difference between the tensile stress at which the first phase transition occurs or starts and the prestress applied to the strings at room temperature is smaller than 400 MPa, more preferably smaller than 300 MPa and most preferably smaller than 200 MPa. In other words, the string material is in the austenitic state, but just below the phase transition. When now a ball hits the string bed of the ball game racket with the usual force, the string material gets into the range of the phase transition and behaves superelastically or pseudoelastically. This means that the string undergoes strain without an increase in stress being required until all austenite has been transformed into martensite. It is thus possible to generate extreme deformations of the strings which may entail, i.a., that the strings form a kind of "pocket" which surrounds the ball to a great extent and thus enable more control in the game. In order to be able to achieve an effect as great as possible, it is preferred that the string material undergoes the complete hysteresis. Therefore, in particular superelastic materials that exhibit a very narrow hysteresis are preferred in this exemplary embodiment. Preferred materials with such a narrow hysteresis are, for example, NiTi and NiTiFe.

In view of the above explanations about the dependence of the increase in stress on the string diameter, as regards strings having a diameter of greater than 1 mm, it is preferred that the difference between the tensile stress at which the first phase transition occurs or starts and the prestress applied to the strings at room temperature is smaller than 200 MPa, more preferably smaller than 175 MPa and most preferably smaller than 150 MPa. As regards strings having a diameter of smaller than 1 mm, it is preferred that the difference between the tensile stress at which the first phase transition occurs or starts and the prestress applied to the strings at room temperature is smaller than 400 MPa, more preferably smaller than 350 MPa and most preferably smaller than 300 MPa.

Another advantage of many superelastic materials is the extraordinarily high elongation at failure of 10 to 20%. This is of importance, i.a., because the strings are fixed by means of knots during tensioning, which entails high elongations at failure. Materials such as, for example, titanium or steel, which can likewise achieve high specific strengths, typically have only small elongations at failure of about 5%. It would practically not be possible to simply unknot such strings.

The strings of the ball game racket according to the present invention can comprise one or more strings made from a non-superelastic material. Alternatively, the entire set of strings can consist of strings comprising or consisting of a superelastic material.

One or more strings of the ball game racket according to the present invention can also only partly consist of or comprise a superelastic material. It is, for example, possible that specific portions along the longitudinal direction of the ball game racket string consist of a superelastic material or comprise a superelastic material, said portions being interrupted by portions that consist of a non-superelastic material. Preferably, in particular the string portions arranged in the centre of the string bed are superelastic. Alternatively or additionally only a part of the string cross-section is configured of a superelastic material. In particular, it is preferred that at least portions of the ball game racket string are hollow and the material surrounding the hollow space is superelastic. In other words, the present invention also relates to a ball game racket string at least portions of which consist of a superelastic jacket surrounding a (preferably cylindrical) hollow space.

Preferred superelastic alloys that are suitable for the ball game racket according to the present invention are: NiTi, NiTiCr, NiTiFe, NiTiCo, NiTiCu, NiTiV, CuZnAl, CuAlNi, FeNiAl, FeMnSi. However, the invention is not limited to these materials since basically also other superelastic or pseudoelastic materials (perhaps unknown so far) can be used for the ball game racket according to the present invention.

The present invention is further directed to the use of a superelastic or pseudoelastic material as string for a ball game racket, in particular for a tennis racket, a squash racket, a badminton racket or a racquetball racket. In particularly preferred uses, the features discussed above as being advantageous can be applied in this connection.

The use of a superelastic material for a ball game racket string according to the present invention offers a number of advantages, as apparent from the above explanations. Strings having a high tensile strength as well as a high tensile stiffness and great elongation at failure while at the same time having a small diameter can be produced by means of superelastic materials. Furthermore, advantage of the phase transition between austenite and martensite can be taken not only for the purpose of adjusting the tensile stiffness as required but also for the purpose of enabling extreme deformations of the string while it undergoes the hysteresis.

Figure 2:
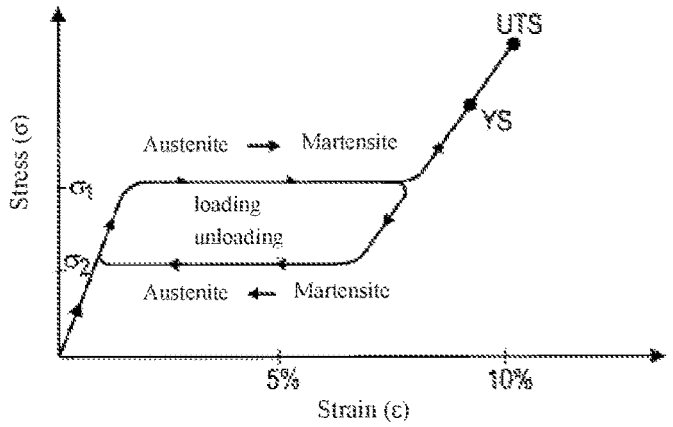

The invention is described in the following with reference to the Figures in more detail, in which:

FIG. 1 shows a stress-strain diagram for several nitinol strings having different diameters; and FIG. 2 schematically shows the phase diagram of nitinol.

In FIG. 1, the stress-strain diagram for four nitinol strings having different diameters is illustrated. The nitinol is superelastic nitinol S/BB having a transition temperature ("austenite start temperature") As of −15° C. The measurement of the stress-strain diagram was made at room temperature. As can be very well seen, there is a "stiff" austenitic range at stresses of about 100 to 500 MPa, at which the nitinol string behaves linearly. At a stress of about 600 to 650 MPa, a phase transition occurs at which austenite transforms into martensite. During this phase transition, the strain of just under 2% increases to over 7% without the stress having to be noticeably increased. As regards higher strains or stresses of about 700 to 900 MPa, there is a second linear range. This is "soft" martensite.

In the two marked ranges, the nitinol string can be used like a conventional string, wherein the tensile stiffness either essentially corresponds to that of a natural gut string (soft martensite) or is considerably higher (stiff austenite). Such a nitinol string behaves like conventional ball game racket strings in so far as in each of the marked ranges the stress increases in proportion to the strain.

Alternatively, however, the nitinol string can also be used in the range of the phase transition, as will be explained in the following by means of a schematic illustration of the hysteresis in FIG. 2. As apparent from FIG. 2, starting from a strain of 0%, the stress initially linearly increases with increasing strain. When the start of the first phase transition, at which austenite transforms into martensite, is reached at a stress $\sigma_1$, the stress essentially remains constant ($\sigma_1$) with increasing strain. When the strain is further increased after the complete transformation into martensite, a second proportional range in the stress-strain diagram is reached until eventually the yield strength YS and the ultimate tensile strength UTS are reached. However, when the strain is reduced again after the complete transformation into martensite, at first the martensite is not directly retransformed into austenite but firstly part of the stress is reduced within the martensite until again the stress $\sigma_2$ is reached. Only at this stress $\sigma_2$ does the second phase transition occur, at which martensite is transformed into austenite, until the starting point of the hysteresis in the phase diagram is reached again.

When, according to a preferred embodiment, prestress just below the stress at which the second phase transition occurs is applied to the strings of the ball game racket according to the present invention, and when the hysteresis curve is so narrow that the stresses typically occurring within the string during playing the ball game racket are higher than the tensile stress at which the first phase transition occurs, the hysteresis curve schematically illustrated in FIG. 2 can be completely run through during playing the ball game racket. When the ball hits the string bed of the ball game racket with sufficient force, the austenite is transformed into martensite and extreme deformations of the strings can occur. While the ball leaves the string bed or thereafter, the martensite is retransformed into austenite so that the next time the ball hits the spring bed the complete transformation can be run through again.

Even though the above statements have been made with the example of a nitinol string, they analogously apply, of course, also to other superelastic materials, wherein the concrete strains and stresses at which the phase transitions occur can, of course, deviate from the values illustrated here.

The strings according to the present invention can be used as longitudinal and/or transverse strings. The racket can be stringed exclusively with superelastic strings or it can be stringed in combination with conventional strings made from nylon, polyester or natural gut.

Strings made from superelastic materials such as, for example, nitinol can be produced, for example, via wire drawing (in the soft-annealed state). Such strings can be basically produced by means of respective dies so as to be round, angular or of any other shape. Nitinol can be coated with various plastics, such as, for example, PTFE.

The invention claimed is:

1. A ball game racket with strings that comprise at least one string comprising a superelastic material, wherein:

the superelastic material includes a first phase transition, at which austenite is transformed into martensite, when a tensile stress applied to the superelastic material increases;

the superelastic material includes a second phase transition, at which martensite is transformed into austenite, when the tensile stress is reduced; and a tensile stiffness of the superelastic material is based on a prestress applied to the strings that is higher than the tensile stress at which the first phase transition occurs.

2. The ball game racket according to claim 1, wherein the at least one string has a diameter of no greater than 1.1 mm.

3. The ball game racket according to claim 1, wherein the first phase transition of the superelastic material occurs at room temperature at a tensile stress between 250 MPa and 900 MPa.

4. The ball game racket according to claim 1, wherein the second phase transition of the superelastic material occurs at room temperature at a tensile stress between 50 MPa and 700 MPa.

5. The ball game racket according to claim 1, wherein the difference between the tensile stress at which the first phase transition occurs and the tensile stress at which the second phase transition occurs at room temperature is smaller than 350 MPa.

6. The ball game racket according to claim 1, wherein the strings comprise at least one further string made from a non-superelastic material or wherein the entire set of strings consists of strings comprising a superelastic material.

7. The ball game racket according to claim 1, wherein the superelastic material comprises one or a combination of the following alloys: NiTi, NiTiCr, NiTiFe, NiTiCo, NiTiCu, NiTiV, CuZnAl, CuAlNi, FeNiAl, FeMnSi.

8. The ball game racket according to claim 1, further including at least one string made from a non-superelastic material.

9. The ball game racket according to claim 1, wherein the at least one string includes a jacket of the superelastic material surrounding a hollow core.

10. The ball game racket according to claim 1, wherein only a part of a cross-section of the at least one string includes the superelastic material.

11. The ball game racket according to claim 1, wherein, along a longitudinal direction of the at least one string, the at least one string includes portions of the superelastic material interrupted by portions of a non-superelastic material.

12. A ball game racket with strings that comprise at least one string comprising a superelastic material, wherein:

the superelastic material includes a first phase transition, at which austenite is transformed into martensite, when a tensile stress applied to the superelastic material increases;

the superelastic material includes a second phase transition, at which martensite is transformed into austenite, when the tensile stress is reduced; and a tensile stiffness of the superelastic material is based on a prestress applied to the superelastic material that is lower than the tensile stress at which the first phase transition occurs.

13. The ball game racket according to claim 12, wherein the difference between the tensile stress at which the first phase transition occurs and the prestress at room temperature is greater than 100 MPa.

14. The ball game racket according to claim 12, wherein the at least one string has a diameter of no greater than 1.1 mm.

15. The ball game racket according to claim 12, wherein the first phase transition of the superelastic material occurs at room temperature at a tensile stress between 250 MPa and 900 MPa.

16. The ball game racket according to claim 12, wherein the second phase transition of the superelastic material occurs at room temperature at a tensile stress between 50 MPa and 700 MPa.

17. The ball game racket according to claim 12, wherein the difference between the tensile stress at which the first phase transition occurs and the tensile stress at which the second phase transition occurs at room temperature is smaller than 350 MPa.

18. A ball game racket with strings that comprise at least one string comprising a superelastic material, wherein:

the superelastic material includes a first phase transition, at which austenite is transformed into martensite, when a tensile stress applied to the superelastic material increases;

the superelastic material includes a second phase transition, at which martensite is transformed into austenite, when the tensile stress is reduced; and a tensile stiffness of the superelastic material is based on a prestress applied to the superelastic material that is lower than the tensile stress at which the second phase transition occurs.

19. The ball game racket according to claim 18, wherein the difference between the tensile stress at which the first phase transition occurs and the prestress at room temperature is smaller than 400 MPa.

* * * * *